US006487943B1

(12) United States Patent
Jansson et al.

(10) Patent No.: US 6,487,943 B1
(45) Date of Patent: Dec. 3, 2002

(54) TORQUE LIMITING SCREWDRIVER

(75) Inventors: Conny Jansson, Västerås (SE); Mattias Magnusson, Enköping (SE); Håkan Bergkvist, Bromma (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 09/684,903

(22) Filed: Oct. 10, 2000

(51) Int. Cl.[7] ..... B25B 23/157
(52) U.S. Cl. ..... 81/475; 81/467
(58) Field of Search ..... 81/467, 473–476

(56) References Cited

U.S. PATENT DOCUMENTS

| | | | |
|---|---|---|---|
| 2,396,040 | A | 3/1946 | Darling |
| 2,797,564 | A | 7/1957 | Bonneau et al. |
| 3,890,859 | A | 6/1975 | Grabovac et al. |
| 4,063,474 | A | 12/1977 | Klopping |
| 4,517,865 | A | 5/1985 | Huang |
| 5,746,298 | A | 5/1998 | Krivec et al. |

FOREIGN PATENT DOCUMENTS

| | | |
|---|---|---|
| DE | 40 22 763 | 1/1991 |
| GB | 900 035 | 7/1962 |

*Primary Examiner*—D. S. Meislin
(74) *Attorney, Agent, or Firm*—Burns, Doane, Swecker & Mathis, LLP

(57) ABSTRACT

A torque-limiting screwdriver includes a shank disposed within a handgrip. A rear end of the shank engages the handgrip to enable an axial force to be transmitted from the handgrip to the shank. A release mechanism is provided to transmit rotation from the handgrip to the shank. The release mechanism is axially movable relative to both the handgrip and the shank and is spring biased into rotation transmitting relationship with the shank, whereby the rotation transmitting force applied to the shank is substantially independent of the axial force applied from the handgrip to the shank.

6 Claims, 2 Drawing Sheets

TORQUE LIMITING SCREWDRIVER

BACKGROUND OF THE INVENTION

The invention relates to torque-limiting screwdrivers which cease imparting a rotary force when a predetermined torque is reached.

In many mechanical operations it is desirable to tighten a screw with a well defined torque, such as when fastening brittle or otherwise easily damaged items, and it is desired to have as high a fastening force without exceeding a predetermined limit. One example of such brittle items is a carbide insert in a turning or milling tool which is secured by a fastening screw. Another example is when a screw is to be threaded into a material having limited strength such as aluminum castings.

For such operations it has long been known to use screwdrivers or other tools which let the handle rotate freely without rotating the screw-engaging tool shank when a preset torque is reached. Examples of hand-held tools of such types are shown in U.S. Pat. Nos. 2,396,040, 2,797,564, 3,890,859, 4,063,474, 4,517,865; British Patent 900,035 and German Patent 40 22 763.

Some of the requirements in connection with torque-limiting screwdrivers are that (a) the torque limit in the tightening direction should be adjustable and defined with high precision, i.e., better than 10% error independent of moisture, wear and lubrication, (b) the torque in the loosening direction should be unlimited, and (c) the act of reaching the limit torque should not cause axial impacts in the tool shank. All known prior art designs fail in one or more of those requirements.

Precision in determination of the torque limit is difficult to achieve with metal release mechanisms, since the friction in such mechanisms is strongly dependent on wear and lubrication. This is true for the following clutch type arrangements: (a) two multi-toothed washers in mutual contact (U.S. Pat. No. 4,517,865), (b) a toothed washer in contact with a single tooth (U.S. Pat. No. 2,797,564), and (c) a toothed washer in contact with a cylinder (British Patent 900,035).

To lessen the dependence upon friction, it has been suggested to provide a clutch in the form of a toothed washer in contact with rollers or balls (see U.S. Pat. No. 3,890,859), but that is difficult to combine with unlimited torque in the loosening direction unless there is added a separate ratchet mechanism such as the type disclosed in U.S. Pat. No. 2,396,040. Tools employing leaf springs acting against profiled shafts or tubes as shown in German Document 40 22 763 or U.S. Pat. No. 5,746,298 are very dependent on friction, and have low precision, e.g., around 20%.

All of the above-mentioned designs will also cause harmful axial impacts and vibrations in the screwdriver shank when the limit torque is reached, except those employing profiled shafts or tubes.

SUMMARY OF THE INVENTION

The present invention concerns a screwdriver where the mechanism and special choice of materials permit definition of a torque limit with high precision, and which is made from considerably fewer components than prior art designs, and which avoids essentially all axial impacts or vibrations in the screwdriver shank.

The invention pertains to a torque-limiting screwdriver which includes a screw-engaging shank disposed in a handgrip, and a torque-limiting element for transmitting a screw-tightening torque between the handgrip and the shank preventing the torque from exceeding a predetermined value. The shank includes a rear end engaging the handgrip for transmitting axial force from the handgrip to the shank. The shank includes teeth spaced from the rear end. A spring is arranged to yieldably urge the torque-limiting element into rotation-transmitting relationship with the teeth.

BRIEF DESCRIPTION OF THE DRAWINGS

A preferred embodiment of the invention is described with reference to the accompanying figures, wherein.

DETAILED DESCRIPTION OF A PREFERRED EMBODIMENT OF THE INVENTION

Figure 1:
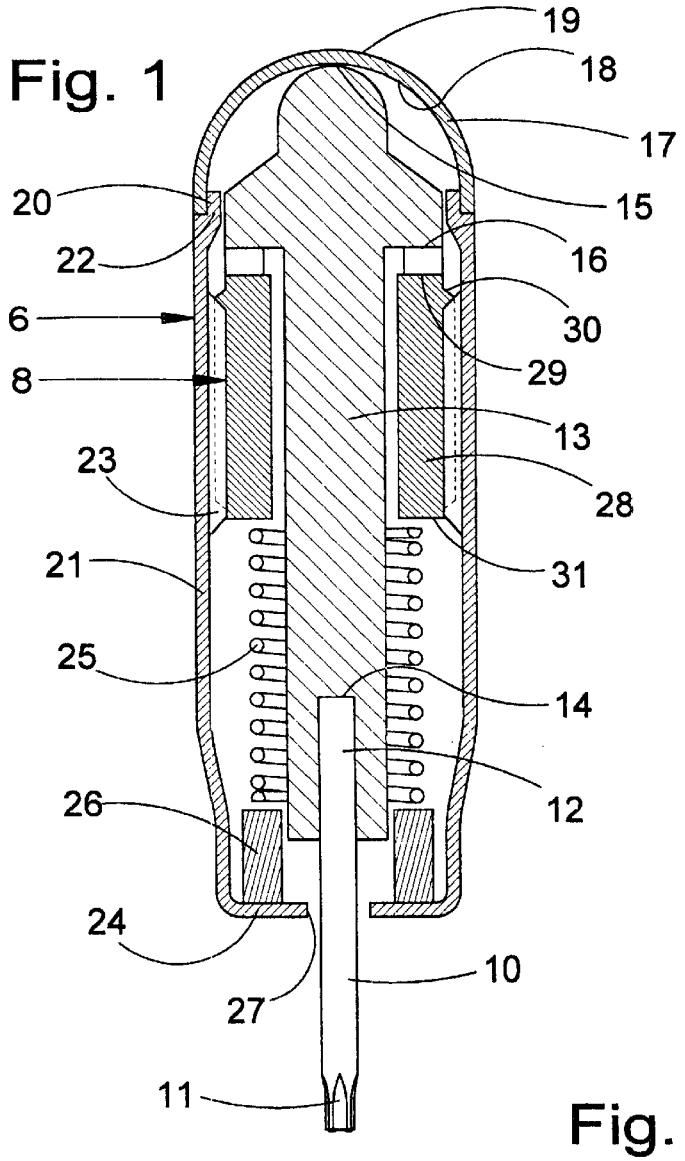
FIG. 1 shows a section through a screwdriver according to the invention.

A screwdriver according to the invention comprises a screw-engaging shank (8), the lower (front) portion (10) of which is preferably made from metal and has a lower end (11) shaped for transmitting torque to a screw. The upper (rear) portion (13) of the shank is preferably made of a polymer material and has at its upper end a thrust surface (15) to convey an axial force from a handgrip (6) to the shank. Thus, the thrust surface (15) and the handgrip together define an axial force transmission interface. The thrust surface may be made integral with the handgrip, or made as a spherical component attached to an upper portion of the handgrip. Below the thrust surface (15) the upper portion (13) includes a toothed surface having first teeth (16) pointing downward for the transfer of torque to the shank. If the portions (10, 13) of the shank are made from different materials, the lower metallic portion (10) may have a joint end (12) pressed into a hole (14) of the upper portion (13) with a cross-sectional shape suitable for the transfer of high torque.

The shank is surrounded by the handgrip (6) which comprises an upper (rear) bowl-shaped portion (17) the inside surface of which (18) rests on the thrust surface (15) while the outside surface (19) is smoothly softly rounded for a comfortable contact with the palm of the user. The exterior surface of at least the lower (front) portion (21) of the handgrip is made from a high friction structure or material in any known way to ensure that the user can manually apply enough torque. The inside surface of the lower portion of the handgrip is made with longitudinal second teeth in the form of splines (23). The lowermost (front) end of the handgrip part is made as a shelf (24) with a round hole (27) through which the shank extends and is guided.

In the lower (front) portion of the handgrip below the splines (23) a spring (25) is located, preferably a metal coil spring, the lower end of which rests against the shelf (24) or against a support washer (26) which in its turn is supported by the shelf (24).

Between the spring (25) and the teeth (16) is located a rotation-transmitting element in the form of a splined cylinder (28) which surrounds the upper portion (13) of the shank. The spring (25) applies an upward (rearward) force to the bottom face (31) of the splined cylinder. Splines (30) disposed on the outside cylindrical surface of the cylinder (28) define third teeth that mesh with the splines (23) to transmit rotation from the handgrip to the cylinder. Thus, the splines (23) and (30) together define a rotary force transmission interface. The splines (23, 30) also enable the cylinder to slide axially relative to the handgrip and the shank when a torque limit is reached. The top face of the splined cylinder is provided with fourth teeth (29) shaped to mesh and interact with the teeth (16) for transmitting rotation from the cylinder to the shank.

The screwdriver is assembled by inserting the support washer (26) (if there is one), the spring (25), the splined cylinder (28) and the shank (or at least its upper portion (13)) into the lower portion (21) of the handgrip. The upper portion (17) of the handgrip is then attached to the lower portion (21) with threads, angular snap fit (20, 22), glue, weld or any other known method.

For a screwdriver according to the invention, the result is that the upwardly (rearwardly) directed force from the upper (rear) end of the spring (25) conveyed through the splined cylinder (28), the teeth (16), the thrust surface (15), the upper portion (17) and the lower portion (21) of the handgrip and the shelf (24) back to the lower end of the spring without affecting the lower portion (10) of the shank. Thus, the force between the teeth (160 and the teeth (29) is essentially totally independent of whatever axial force the user applies to the handgrip. Thus, since the axial force transmission interface defined by the contact between the rear end of the shank and the handgrip is spaced from the rotary force transmitting interface defined by the teeth (23, 30), and since the cylinder (28) is movable axially relative to the handgrip and the shank, the torque limit is defined exclusively by the spring 25.

In prior art such as U.S. Pat. No. 4,517,865 and British Patent No. 900,035, reaching the limit torque will induce downward impact on the shaft, which may cause the same type of damage one tried to avoid by limiting the torque, and with both of those designs a downward thrust by the user will counteract the relative sliding between the toothed surfaces of the clutch and permit higher torque than the intended limit.

Figure 3:
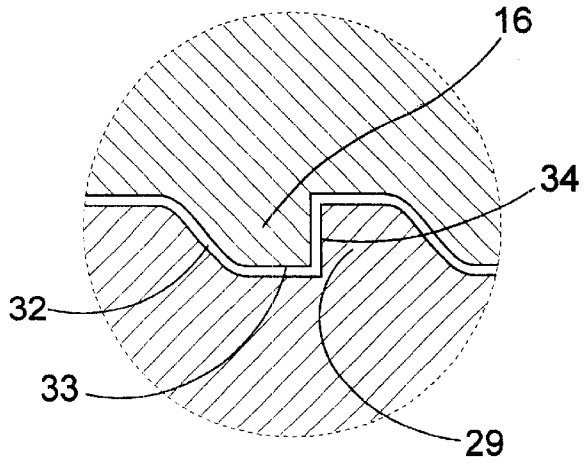
FIG. 3 shows an enlarged view of the teeth of the release mechanism.
Figure 2:
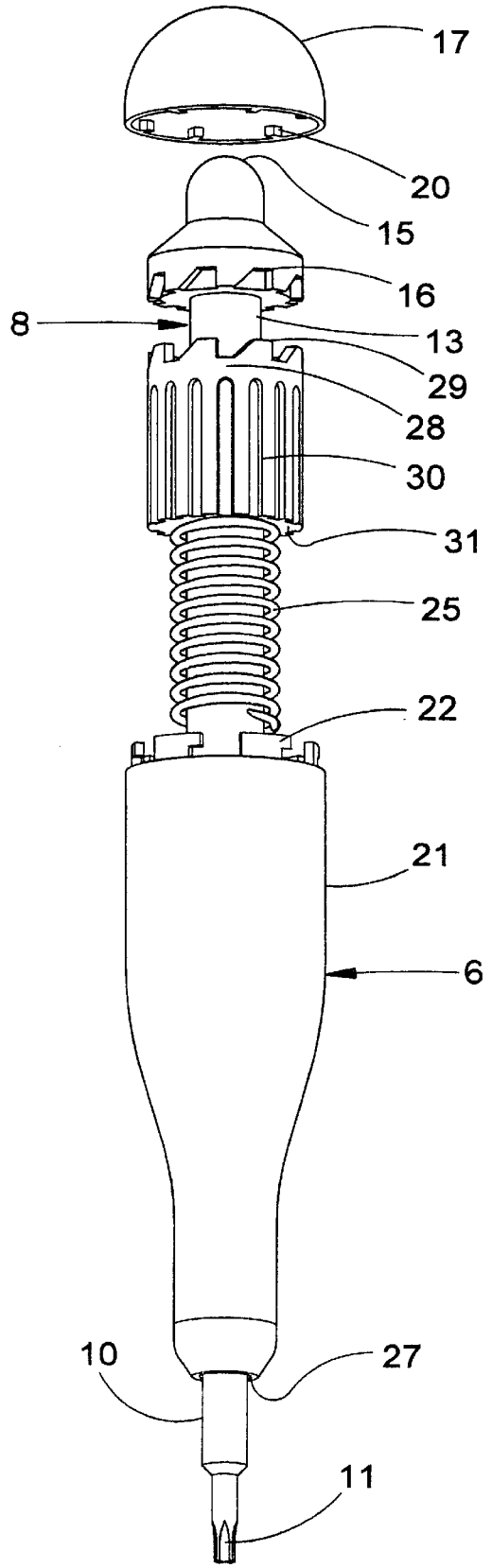
FIG. 2 shows the components of the screwdriver before assembly.

FIG. 3 shows an enlarged detail view of the teeth (16) of the shank and the teeth (29) of the cylinder (28). Each of those teeth is made with one sloping side (32) which transfers the torque in the tightening direction, one horizontal top surface (33) where the teeth slide over each other after reaching the limit torque, and one vertical side (34) where the torque is transferred in the loosening direction without being limited. The sloping side can be flat as shown in the figure, or have a rounded transition to the flat top surface. To make the torque limit well defined, the friction coefficient between the teeth (16, 29) should be small and not affected by moisture, lubrication, wear or corrosion. In prior art the torque is made independent of a friction coefficient by the use of rollers instead of sliding surfaces of the teeth, but that is difficult to combine with unlimited torque in the loosening direction. According to the invention, at least the teeth (16, 29), but preferably the whole upper portion (13) of the shank and the splined cylinder (28), should be made from a conventional polymer which is capable of repelling water and oil, such as an acetal polymer like polyoxymethylene. Preferably one set of the teeth, such as those on the splined cylinder, can be made with a friction limiting filler such as molybdenum sulphide.

Prior art designs using toothed washers as torque-limiting members have not provided the teeth with horizontal surfaces (33) on top of the teeth, and that makes them very sensitive to overloading and fractures at the tops, since both the torque and the axial thrust reach their maximum at the same time that the contact surface during sliding decreases to zero. Damage to the tooth tops will cause larger friction and larger limit torque than intended. According to the invention, the tops of the teeth are horizontal, i.e., they lie in a plane oriented perpendicular to the shank axis, which makes the tooth tops slide upon each other as soon as the limit torque has been reached, and the torque is suddenly reduced without any local overloading.

It will also be appreciated that when the torque limit is reached, the sliding of the teeth (16, 29) over one another will produce a downward displacement of the cylinder (28) which isolates the shank and the handgrip from appreciable impacts, and thereby prevents an appreciable back force from being applied to the user's hands, thus optimizing comfort for the user.

Adjustment of the screwdriver to different values for the limit torque can be made by different methods. A first method is by choosing one among different springs (25) with a suitable stiffness to produce the intended thrust after assembly. A second method is to use one predetermined spring and produce the intended thrust values by choosing support washers (26) of different thicknesses. A third method is to make the support washer axially movable with an externally operable screw mechanism as known from several of the mentioned prior art designs.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A torque-limiting screwdriver comprising a screw-engaging shank disposed in a handgrip, and a torque-limiting element for transmitting a screw-tightening torque between the handgrip and the shank and preventing the torque from exceeding a predetermined value, the improvement wherein the shank includes a rear end engaging the handgrip for transmitting axial force from the handgrip to the shank; the shank including teeth spaced from the rear end; a spring arranged to yieldably urge the torque-limiting element into rotation transmitting relationship with the teeth, wherein the torque-limiting element includes a cylinder having teeth at its rearward end and splines along its exterior cylindrical surface, the splines being in rotation-transmitting relationship with the handgrip, and the teeth being in rotation-transmitting relationship with the teeth of the shank.

2. A torque-limiting screwdriver comprising:

a handgrip comprising a side portion, a rear end and a front end, the side portion including an inner surface having first teeth thereon;

a shank disposed in the handgrip and including a screw-engaging end projecting from the front end of the handgrip, a rear end of the shank engageable with the rear end of the handgrip to define an axial force transmission location where axial force from the handgrip is transmitted to the shank to urge the shank along a center axis of the shank, the shank including second teeth;

a rotation transmitting element surrounding a portion of the shank, the rotation transmitting element including third teeth in mesh with the second teeth for transmitting rotation from the handgrip to the rotation transmitting element about the center axis, the rotation transmitting element including fourth teeth in mesh with the first teeth for defining a rotary force transmission location where rotary force from the rotation transmitting element is transmitted to the shank, the first and fourth teeth configured to release the rotation transmitting element from rotation transmitting relationship with the shank when a predetermined torque is reached during a screw-tightening operation, the rotary force transmission location being spaced from the axial force transmission location, the rotation transmitting element being movable axially relative to both the handgrip and the shank; and a spring arranged to act on the rotation transmitting element for yieldably biasing the fourth teeth into engagement with the first teeth.

3. The screwdriver according to claim 1 wherein each of the teeth of the shank and each of the teeth of the cylinder has a horizontal top surface and a sloping side surface.

4. The screwdriver according to claim 1 wherein the cylinder and the teeth of the shank are formed of a water/oil repellant polymer.

5. The screwdriver according to claim 4 wherein the polymer comprises polyoxymethylene.

6. The screwdriver according to claim 4 wherein the polymer of the cylinder includes an anti-friction filler.

* * * * *